US006501439B2

(12) United States Patent
Keilen

(10) Patent No.: US 6,501,439 B2
(45) Date of Patent: Dec. 31, 2002

(54) FLEXIBLE SUBSTRATE WIDE BAND, MULTI-FREQUENCY ANTENNA SYSTEM

(75) Inventor: Don Keilen, Sparks, NV (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/866,310

(22) Filed: May 25, 2001

(65) Prior Publication Data

US 2002/0014996 A1 Feb. 7, 2002

Related U.S. Application Data

(60) Provisional application No. 60/207,602, filed on May 26, 2000, provisional application No. 60/211,099, filed on Jun. 12, 2000, and provisional application No. 60/211,569, filed on Jun. 15, 2000.

(51) Int. Cl.[7] ..... H01Q 1/36
(52) U.S. Cl. ..... 343/895; 343/700 MS
(58) Field of Search ..... 343/895, 702, 343/742, 700 MS, 844, 867, 767

(56) References Cited

U.S. PATENT DOCUMENTS

| | | | | | |
|---|---|---|---|---|---|
| 4,751,515 | A | * | 6/1988 | Corum | 343/742 |
| 4,766,444 | A | * | 8/1988 | Conroy et al. | 343/895 |
| 5,898,406 | A | * | 4/1999 | Matero | 343/702 |
| 6,337,662 | B1 | * | 1/2002 | Cassel | 343/702 |

* cited by examiner

*Primary Examiner*—Don Wong
*Assistant Examiner*—James Clinger
(74) *Attorney, Agent, or Firm*—Fulbright & Jaworski L.L.P.

(57) ABSTRACT

An antenna assembly including a resonator element which is operatively connected to the ground plane of a wireless communication device (WCD) is described. The resonator element comprises a flexible resonator support substrate of dielectric material which supports a conductive element or portion. The flexible nature of the substrate facilitates coupling to the ground plane of a WCD at a variety of locations including the interior, the exterior, or within a portion of the housing of the WCD itself. The resonator element may be provided with a dielectric support element which operatively connects the resonator element to the ground plane of a printed wiring board of a WCD. The support element includes a predetermined support edge portion which helps maintain the resonator element in a preferred predetermined shape, and a bottom edge with a conductive strip portion which is used to operatively connect the support element to a ground plane. The resonator element includes a conductive portion which may take several embodiments. In one preferred embodiment, the conductive portion is a wire member which is coiled about the flexible resonator support substrate. In another preferred embodiment, the conductive portion includes a conductive channel-shaped layer and at least one trace or line spanning the sides of the channel-shaped layer. In another preferred embodiment, the conductive portion includes a conductive layer deposited on the flexible resonator support substrate in an array pattern. All of the preferred resonator embodiments include a discrete electrical connection location which is operatively connected to separate signal and ground lines, and whose position may be varied depending upon the frequency ranges and performance requirements.

36 Claims, 8 Drawing Sheets

FLEXIBLE SUBSTRATE WIDE BAND, MULTI-FREQUENCY ANTENNA SYSTEM

The applicant for utility patent coverage in the U.S. for the invention taught, enabled, and claimed in this application for Letters Patent, hereby incorporates by reference and under 37 CFR §119(e) claims the benefit of priority of the respective filing dates accorded the following three provisional patent applications earlier filed with the U.S. Patent and Trademark Office, namely:

(i) U.S. Provisional Patent Application No. 60/207,602 filed May 26, 2000 and entitled, "Flexible Substrate Multiple Band Wire Antenna System,"

(ii) U.S. Provisional Patent Application No. 60/211,099 filed Jun. 12, 2000, and entitled, "Wide Band Dual Frequency Compact Antenna, and, (iii) U.S. Provisional Patent Application No. 60/211,569 filed Jun. 15, 2000, and entitled, "Flexible Substrate Multiple Band Antenna System."

FIELD OF THE INVENTION

The present invention finds primary utility in the field of wireless communications. More particularly, the present invention relates to an antenna assembly suitable for wireless transmission of analog and/or digital data in a single or multiple frequency band antenna system.

BACKGROUND OF THE INVENTION

A variety of prior art antennas are currently used in wireless communication devices. One type of antenna is an external half wave single or multi-band dipole. This antenna typically extends or is extensible from the body of a wireless communication device (WCD) in a linear fashion. While this type of antenna is acceptable for use in conjunction with some WCDs, several drawbacks impede greater acceptance and use of such external half wave single or multi-band dipole antennas. One significant drawback is that the antenna is typically mounted at least partially external to the body of a WCD which places the antenna in an exposed position where it may be accidentally or deliberately damaged, bent, broken, or contaminated.

Furthermore, due to the physical configuration of this class of omni-directional antenna, optimizing performance for a particular polarization and/or directional signal is not an option. That is, these types of prior art antennas are relatively insensitive to directional signal optimization or, said another way, these types of prior art antennas can operate in a variety of positions relative to a source signal without substantial signal degradation. This performance characteristic is often known as an "omni-directional" quality, or characteristic, of signal receipt and transmission. This means that electromagnetic waves radiate substantially equally in all directions during transmitting operations. Such prior art antennas also are substantially equally sensitive to receiving signals from any given direction (assuming adequate signal strength). Unfortunately, for a hand held WCD utilizing such a prior art antenna, the antenna radiates electromagnetic radiation toward a human user of the WCD equipped with such an antenna as there is essentially no front-to-back ratio. For reference, the applicant notes that for multi-band versions of prior art types of antenna, the external half wave single or multi-band dipole antenna (i.e., where resonances are achieved through the use of inductor-capacitor (LC) traps), signal gain on the order of approximately a positive two decibels (+2 dBi) are common and expected.

In addition, due mainly to the inherent shape of such prior art antennas, when operating they are typically primarily sensitive to receiving (and sending) vertical polarization communication signals and may not adequately respond to communication signals that suffer from polarization rotation due to the effects of passive reflection of the communication signals between source and receiver equipment. Furthermore, such prior art antennas are inherently inadequate in sensitivity to horizontal polarization communication signals.

Another type of prior art antenna useful with portable wireless communication gear is an external quarter wave single or multi-band asymmetric wire dipole. This type of antenna operates much like the aforementioned external half-wavelength dipole antenna but requires an additional quarter wave conductor to produce additional resonances and, significantly, suffers the same drawbacks as the aforementioned half wave single band, or multi-band, dipole antenna.

Therefore, the inventor recognizes and addresses herein a need in the art of WCD antenna design for an antenna assembly which is compact and lightweight, that is less prone to breakage and has no moving parts (which may fail, become bent, and/or misaligned), and, which utilizes the available interior spaces and structure of a WCD to achieve a more compact final configuration.

There is also a need for a multi-frequency antenna assembly which is able to receive and transmit electromagnetic radiation at one or more preselected operational frequencies.

There is also a need in the art for a deformable antenna resonator which is equally responsive to a variety of different communication signals having a variety of polarization orientations.

There also exists a need in the art for an antenna assembly which is compact and lightweight and which can receive and transmit electromagnetic signals at one or more discrete frequencies and which antenna assembly can be tuned to one or more frequencies.

SUMMARY OF THE INVENTION

The invention herein taught, fully enabled, described and illustrated in detail herein is a multiple band antenna assembly for use in a wireless communication device (WCD) which meets the shortcomings of the prior art. The inventive antenna assembly of the present invention includes a deformable resonator element disposed on a dielectric resonator support substrate and operatively electrically connected to both an RF signal line and to a ground plane associated with a WCD. The resonator element comprises a substrate which supports a conductive element or portion.

The deformable substrate of the resonator element is preferably sufficiently flexible to permit fabrication of a variety of antenna shapes and configurations depending on the available space within a WCD. The flexibility of the substrate allows for a variety of shapes for the resonator element to be coupled to WCDs at a variety of locations with respect to the WCD, including discrete single or multiple locations disposed in the interior, the exterior, and/or located at discrete locations along the periphery of electronics disposed within a portion of the housing of the WCD. Preferably, the resonator element is curved or arcuately shaped, however, other configurations are possible and clearly within the purview of those skilled in the art to which the present invention is directed.

The resonator element also includes a conductive portion which may take several forms in different embodiments of the present invention. In one preferred embodiment, the conductive portion is a wire member which is coiled about the flexible resonator support substrate. In another embodiment, the conductive portion includes at least one trace of electrically conducting material spanning the resonator element and contacting a conductive layer. In another preferred embodiment, the conductive portion includes an array of deposited conductive material in contact with a continuous conductive layer. All of the preferred resonator embodiments of the present invention include a discrete electrical connection location which is operatively coupled to separate signal and ground lines. The position of the discrete electrical connection location may be varied depending upon the frequency ranges and performance requirements for a given application or a particular configuration or style of WCD.

The resonator element is preferably provided with a generally planar bridge, or support, element which mechanically supports and electrically couples the resonator element to the ground plane of reduced electrical potential preferably disposed on or in a printed wiring board of a WCD. The bridge or support element is formed of dielectric material and includes a first edge portion which helps support and maintain the resonator element in a desired, preferably arcuate, configuration. In one embodiment, the support element also has an edge portion with a conductive strip portion which is used to operatively connect the support element to a ground plane.

The antenna assembly comprises a dielectric resonator support element and an electrically conducting resonator element and an electrical connector element electrically coupling the resonator element to the ground plane of the WCD. The resonator support element may itself support the resonator element or may include another a preformed resonator support substrate which in combination with a dielectric bridge member supports the resonator element, respectively, or supported directly by a substrate having discrete electrical components coupled thereto (i.e., the printed wiring board, or "PWB") providing function to the overall operation of a WCD.

In one preferred embodiment, the resonator element includes an outwardly facing conductive portion with a plurality of inwardly facing discrete conductive portions electrically coupled thereto. More specifically, the outwardly facing portion of the resonator element may comprise an elongated band or sheet of electrically conductive material, and the inwardly facing conductive portions comprise a plurality of transverse bands of electrically conducting material electrically coupled to and spaced from the outwardly facing portion. Preferably, the flexible resonator support substrate is in a supporting relation to the outwardly and inwardly facing conductive portions and is comprised of a material (such as laminated epoxy, cyanate ester, polyimides, PTFE, etc.) having dielectric properties. The resonator element may be formed into a variety of shapes, for example, a "C-shaped" member, and the resonator support member may have a "D-shaped" member that when configured as taught herein share a common curvature, or cooperative supporting orientation or configuration. With respect to the "deformable"characteristic of the resonator member, said characteristic is useful primarily during manufacture of the antenna assembly of the instant invention and does not contribute meaningfully to any functionality of the resulting antenna assembly.

In one embodiment, an electrically conducting connector element is preferably located adjacent the dielectric bridge member and the connector is bifurcated (e.g., shaped with elongate dual fork features) with the major end configured to operatively connect to the resonator element and the minor ends configured to operatively connect to the ground plane of a WCD and a radio frequency (RF) input/output signal feed, respectively.

The dielectric bridge member may optionally support an electrically conducting area or patch electrically coupled to the ground plane of the WCD thereby extending the effective electrical length of the ground plane. Generally, the dielectric bridge member and the flexible resonator support substrate are comprised of material having sufficient dielectric properties and may vary in thickness, shape, size and composition but generally are intended to provide mechanical support to the electrified components of the WCD, including the antenna assembly. In one embodiment of the present invention an integrated monolithic substrate member performs all the functions of the first and dielectric bridge member described herein in reference to preferred embodiments.

Generally, the dielectric bridge member and resonator support member presents a substantially planar surface including opposing major support surfaces and a support edge designed to conform to support the deformable flexible resonator support substrate. The support edge is provided with a plurality of stand-offs which enable the dielectric bridge member to contact the flexible resonator support substrate in a non-conductive relation. The downwardly facing edge includes a pair of downwardly extending tabs through which the antenna assembly may be attached to the printed wiring board of a WCD.

The resonator support substrate and the dielectric bridge member are connected to each other in a preferably orthogonal configuration and in combination with the resonator element electrically coupled to the printed wiring board and attendant ground plane of a WCD thus forming the antenna assembly.

As will be appreciated by those of skill in the art to which the invention is directed, the size, shape, physical configuration, electrical and frequency performance characteristics of the antenna assembly will depend in part on the particulars of a given WCD design iteration in view of desired operating frequency (or frequencies), interior dimensions, electrical power constraints, composition of WCD components, and the like. Further, the antenna assembly may be coupled to a WCD at a variety of locations, including the interior, the exterior, within a portion of the housing of the WCD itself, and may be coupled via a suitable antenna interface outlet using conventional components.

It is an object of the present invention to provide a compact antenna assembly designed to be incorporated into a variety of WCDs by conforming to diverse geometries within the interior space of such devices.

It is another object of the present invention to reduce the potential for damage and/or breakage of traditional antenna designs by reducing external parts to a minimum and firmly mounting antenna assembly components to pre-existing structure of compact WCDs.

It is another object of the present invention to simplify construction of an antenna assembly according to the present invention through use of known and traditional antenna, semiconductor, and electronic device fabrication techniques and technologies for production of multiple frequency band antennas.

Accordingly, another feature of the present invention is to provide a compact and effective family of designs for an antenna assembly operable in more than one frequency band.

In addition, with respect to said family of multi-frequency antenna designs, a further feature of the present invention is a single dedicated discrete electrical connection location selectively defining each frequency band while commonly electrically coupled at a single contact location to both the RF signal line and the associated ground plane.

Yet another feature and advantage of the present invention relates to a family or class of antenna assembly designs capable of conforming to existing structure of a compact WCD into which it is incorporated, including incorporating all components and electrical connections for the antenna assembly during original manufacture of the WCD on a common dielectric substrate member or members supporting the electrical circuit components of the WCD.

Still another feature of the present invention relates to the several effective antenna assembly embodiments thereof having no portion thereof external to the WCD and having no moving parts subject to breakage, physical degradation or other loss.

It is an additional object and feature of the present invention to provide an antenna assembly which may be incorporated into a WCD and wherein the resonating element portion of the antenna assembly is tunable over a range of discrete frequencies.

These and other objects, features and advantages will become apparent in light of the following detailed description of the preferred embodiments in connection with the drawings. Those skilled in the art of WCD antenna design will readily appreciate that these drawings and embodiments are merely illustrative and not intended to limit as to the true spirit and scope of the invention disclosed, taught and enabled herein.

DETAILED DESCRIPTION OF THE PREFERRED EMBODIMENTS

Referring generally to the drawings described above and appended hereto, the preferred embodiments of the present invention provide a multiple frequency band antenna assembly for many different types of wireless communication device such as cellular, mobile, and portable telephones; electronic paging devices; hand-held, so-called "laptop," and desktop computers and computerized workstations; personal digital assistant (PDA) devices; and other wireless communication devices. The class of antenna assemblies of the present invention also finds use in wireless appliances in general whether operating in a residential, office, and/or manufacturing environment. Furthermore, the antenna assemblies described, illustrated and taught herein may be used in conjunction with a WCD mounted or carried in a variety of vehicles, including land, sea, air and space vehicles and may transmit and/or receive data and information comprising data, images, text, voice and the like. In addition, the antenna assemblies of the present invention may operate in a wireless network such as a local area network (LAN), a wide area network (WAN) and/or may remotely couple to a global computer network via communication protocols such as transmission control protocol/internet protocol (TCP/IP), as now known and understood in the art or as later devised to accommodate high bandwidth data transfer requirements, and the like.

Figure 1:
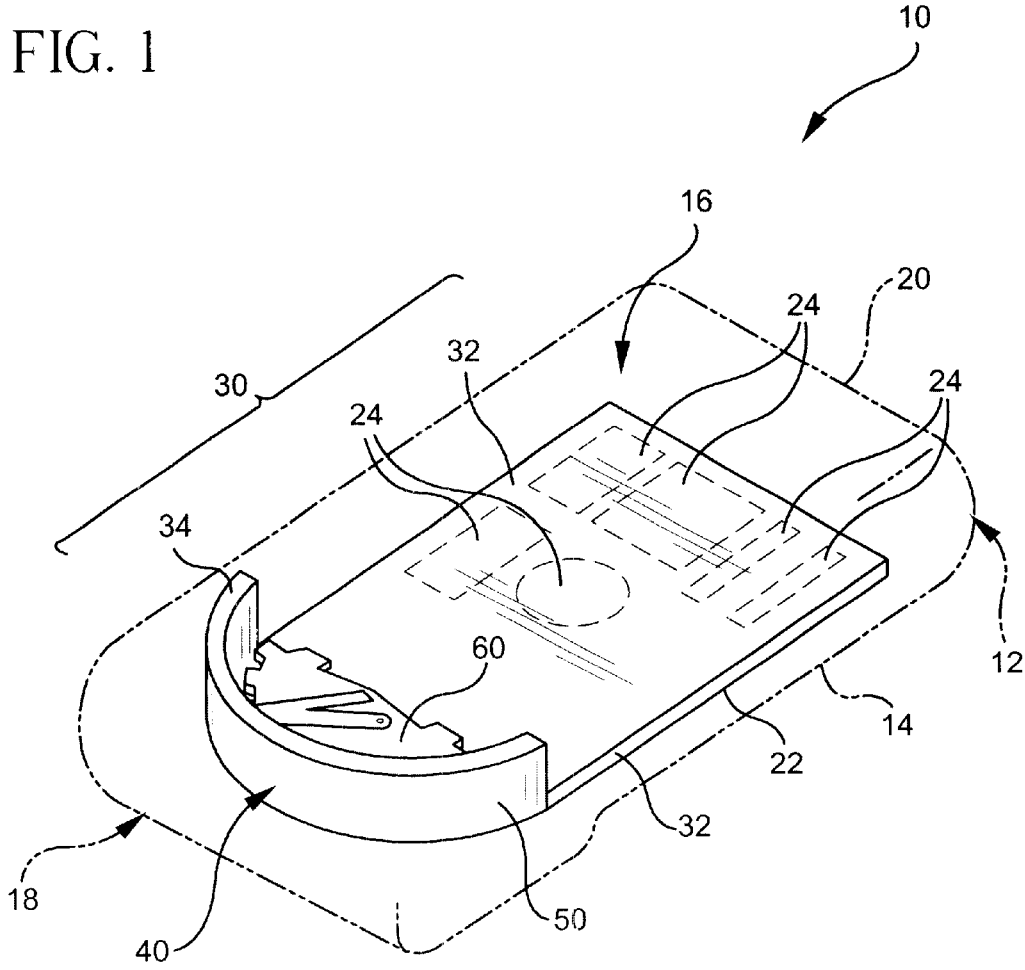
FIG. 1 is a perspective view of a WCD having an antenna assembly according to the present invention disposed in an interior cavity of said WCD.

As depicted in FIG. 1, a typical wireless communication device (WCD) 10 includes a housing 12 with a front 14, back or rear 16, top 18 and bottom 20. The WCD 10 typically includes a printed wiring board (PWB) 22 onto which various electronic components 24 are connected, and also includes a ground plane 32 typically disposed on or within the printed wiring board 22 formed of electrically conducting material and which forms part of an antenna assembly 30 according to the present invention. Operationally, the antenna assembly 30 includes a resonator assembly 34 which is operatively coupled to both the electronic components 24 and the ground plane 32 of the WCD 10. Note that internal electrical components and electrical connections therebetween of the WCD 10 are omitted or depicted in phantom to facilitate a clearer understanding of the antenna assembly 30.

As depicted in FIG. 1, the antenna assembly 30 includes a resonator assembly 34 which is electrically coupled both to the ground plane 32 and to an RF input/output signal connection of the WCD 10. WCD 10 includes assorted interconnected electrical circuitry 24 to transmit and receive communication signals in the form of electromagnetic radiation. In this disclosure, resonator assembly 34 may be shaped generally in an arc having a constant radius and defining an outwardly facing surface and an inwardly facing surface, although a large variety of shapes and sizes of resonator assembly 34 may be utilized as further described herein. For example resonator assembly 34 may be comprised of metallic wire, electrically conducting material formed in sheets, deposited in traces, patches, or embedded into supporting structure.

The resonator assembly 34 includes a flexible resonator support substrate 50 supporting a conductive resonator element 40 formed of electrically conducting material. As will be discussed herein, the resonator element 40 may be wire windings, sheets, plates, serpentine traces, meander-type antenna shapes, or may comprise two or more windings, traces or meander shapes disposed upon a single support substrate 50, a set or stack of support substrate members (not shown) or upon two support substrates of different radius arc shapes. The number of and spacing between portions of the resonator element 40 affects the sensitivity of the antenna assembly 30 to different frequencies, signal direction(s), and polarization direction of the transmitted and the received communication signals.

The resonator element 40 and may be manufactured or fabricated using standard printed circuit board technologies such as metallic deposition, chemical vapor deposition, thin film technology, etching and deposition processes, electroplating techniques, and electroless plating. Electroless plating is a preferred fabrication technique for the resonator element 40 of the present invention and typically involves use of a redox reaction (i.e., reduction of a complexed metal using a mild reducing agent) to deposit metal onto an object without the passage of electrical current through the object. This technique allows a constant metal ion concentration to bathe all parts of an object and thus deposits metallic material evenly along edges, inside holes (or vias), and over irregularly shaped objects. Electroless plating also allows plating of non-electrically conducting materials which can then be electroplated, if desired. Alternatively, the electrically conducting resonator element 40 may be thin conductive foils or wiring which may be suitably attached, for example, by adhesives, fusion, soldering, welding, or tension, to the flexible resonator support substrate 50.

The flexible resonator support substrate 50 may be constructed of a deformable or flexible dielectric material, flexible printed circuit board material, rigid pre-formed dielectric material, such as a resin-based materials, whether impregnated with epoxy, fibers, or simply formed via injection molding and the like. The support substrate 50 can comprise a single unitary member, more than one member or different arc-shaped members having the same (or different) radius curvature. In addition, the support substrate 50 can have a single curve (as depicted in FIG. 1) or can form simple or complex curved and/or rectilinear shapes. Preferably, the support structure 50 should be configured to maximize use of interior mounting locations and available interior spaces for a given WCD 10. In any event, support structure 50 may comprise L-shape or V-shape, an M-shaped or a non-constant radius curved shape and for a given WCD 10 more than one support structure 50 may be mounted in diverse locations or adjacent to each other of said support structure 50.

The resonator assembly 40 further includes a bridge support element 60, preferably formed of a dielectric material. The bridge member 60 is planar and includes opposing major planar surfaces and a support edge. The major surfaces 6 include respective conductive elements as will be further described herein.

Figure 2:
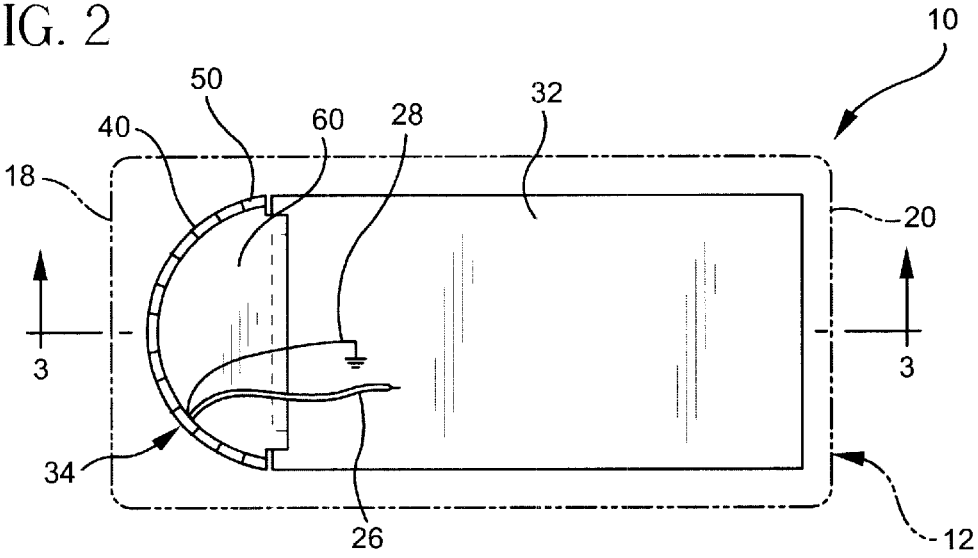
FIG. 2 is a plan view of a WCD including one embodiment of an antenna assembly in a preferred configuration.
Figure 3:
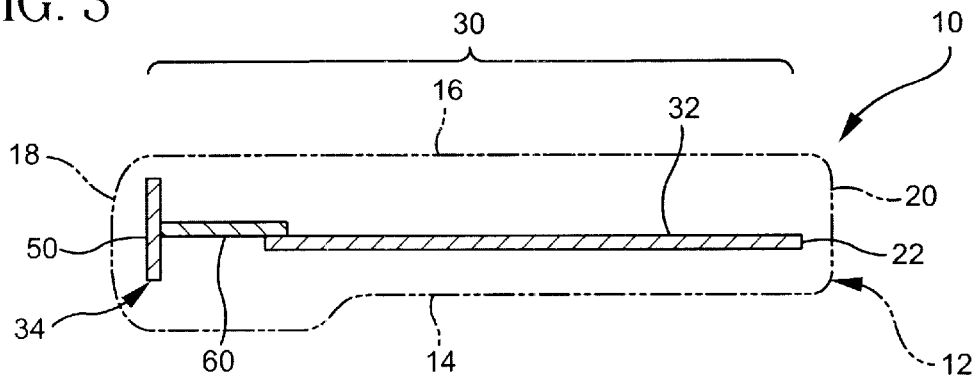
FIG. 3 is an elevational cross sectional view of the WCD depicted in FIG. 2 taken along line 3—3 of FIG. 2.

FIGS. 2 through 8 depict another embodiment of an antenna assembly according to the present invention. As depicted in FIGS. 2 and 3, the antenna assembly 30 is able to fit within the If confines of a WCD 10 (housing shown in phantom). As will be appreciated, by using deformable dielectric material for the resonator support substrate 50, it is advantageously suited to be shaped and configured as needed to accommodate interior dimensional constraints of the housing 12 of WCD 10. Alternatively, the resonator element 40 may be incorporated within a portion of the structure of the housing 12 itself or attached to the exterior of the housing 12. The number and the shape of the support substrate 50 may vary. For example, dual resonator assemblies 34 (and/or whole antenna assemblies 30) may be disposed in, for example, opposing ends or sides of a WCD 10 and each may share a common ground plane 32.

With reference to FIGS. 2 and 3, note that the flexible resonator support substrate 50 and the dielectric bridge member 60 are mechanically coupled at several locations to promote a constant shape and configuration to the resonator support substrate 50 and ultimately the resonator element 40. The flexible resonator support substrate 50 and the dielectric bridge member 60 are preferably coupled together in a more or less perpendicular orientation to promote strength to the resulting structure but may intersect to form an angle between the substrate 50 and he bridge member 60 that is more or less than ninety degrees (i.e., not perpendicular). Such orientations permit the antenna assembly 30 to be configured or tailored into different shapes and configurations. While the angle formed by the flexible resonator support substrate 50 and the dielectric bridge member 60 is depicted in the drawings does not vary substantially from approximately 90 degrees, it is understood that other angles may be selected without affecting the overall performance of the antenna assembly 30. Moreover, it is understood that the flexible resonator support substrate 50 may be shifted forwardly or rearwardly in a linear fashion with respect to the dielectric bridge member 60 to bring the resonator element 40 closer to or farther away from a user of the device. While the support substrate 50 and the resonator element 40 are depicted in the drawings as complementary "C-shaped" members, other shapes may be used. A criteria for selecting the final shape or configuration is that it the resulting resonator element 40 provide adequate directional sensitivity and tolerate a variety of polarizations. The C-shape meets these criteria. Although "L-shape" or "V-shape" or a meander or serpentine shape to the support substrate 50 and the resonator element 40 may be desirable and useful. Of course, in addition to the overall shape of the resonator element 40, the chosen fabrication materials may vary to suit individual design applications for a WCD 10. That is, metallic wire, conductive traces, solid metal, and conducting polymer may be substituted for the illustrated forms for resonator element 40, if desired, when practicing the present invention.

Figure 4:
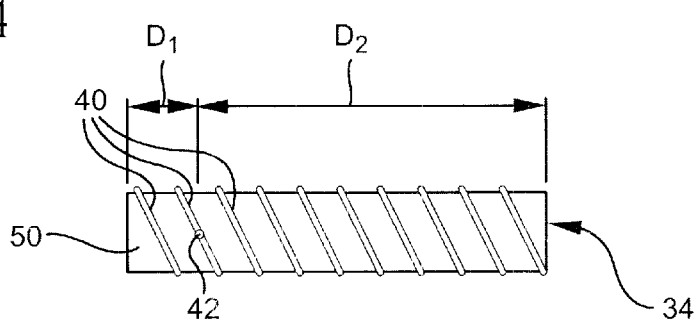
FIG. 4 is an elevational view of a resonator element of the antenna assembly of FIG. 2.

FIG. 4 is an elevational side view of one preferred embodiment of the inner surface of resonator element 40. Flexible resonator support substrate 50 is rectangularly shaped and carries the resonator element 40 in the form of a wire member. Wire member resonator element 40 is wound about flexible resonator support substrate 50 in a generally spiral manner. The size, composition and number of each adjacent turn of wire member 40, and the spacing between turns of wire member 40 around flexible resonator support substrate 50 can be selected to precisely match the input impedance of the WCD. For reference, FIG. 5 is a perspective view of the preferred embodiment depicted in FIG. 4.

Figure 5:
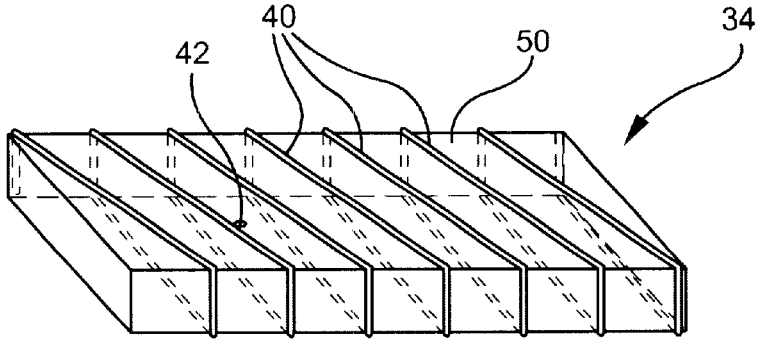
FIG. 5 is a perspective view of the resonator element of the antenna assembly of FIG. 2.

As shown in FIG. 4 and FIG. 5, wire member 40 includes a discrete electrical connection location 42 on the inner surface of the dielectric support 50. Discrete electrical connection location 42 divides the wire member 40 into two portions, designated by dimensions $D_1$ and $D_2$. This enables the resonator 40 to operate at frequencies which are proportional to the divided portions and the total length of the wire member 40. The discrete electrical connection location may be positioned along the length of the wire member 40 to obtain the desired frequencies. Alternative configurations and materials may also be practicable, including meander forms, and the like. Discrete electrical connection location 42 may be connected to a feed line, which may be connected to the printed wiring board by coaxial cable, microstrip line, or other methods which will be apparent to those skilled in the art. For example, a resonator element 40 may have differing radius arc-shapes, compound shapes, and sizes from a second resonator element 40 and each will preferably increase signal sensitivity and range for either a common operating frequency or set of operating frequencies.

As shown in FIG. 2, the resonator element 34 of the antenna assembly is electrically coupled at signal connection 42 to both the ground plane 32 (via conductor 28) and to an RF signal line 26. RF signal line 42 may be a coaxial line or utilize other known signal transmission elements, including but not limited to microstrip transmission lines, etc. The signal connection 42 operatively couples the WCD 10 to the resonator element 40 and divides the resonator element 40 into two segments in a ratio of roughly 1/3 (one-third) to 2/3 (two-thirds). This allows the resonator element 40 to operate at two bands having roughly the same ratio. It should be apparent that the electrical attachment location, or terminal, 42 may be located at other inwardly facing conductive portions along the resonator element 40 to provide different operational bands. And, it will be appreciated that the orientation of the signal connection, or terminal, 42 of the conductive element 40 could be changed accordingly.

Figure 6:
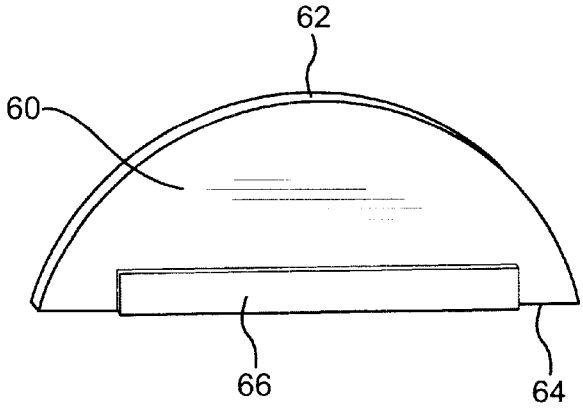
FIG. 6 is a perspective view of a dielectric bridge member of the antenna assembly depicted in FIG. 1.
Figure 7:
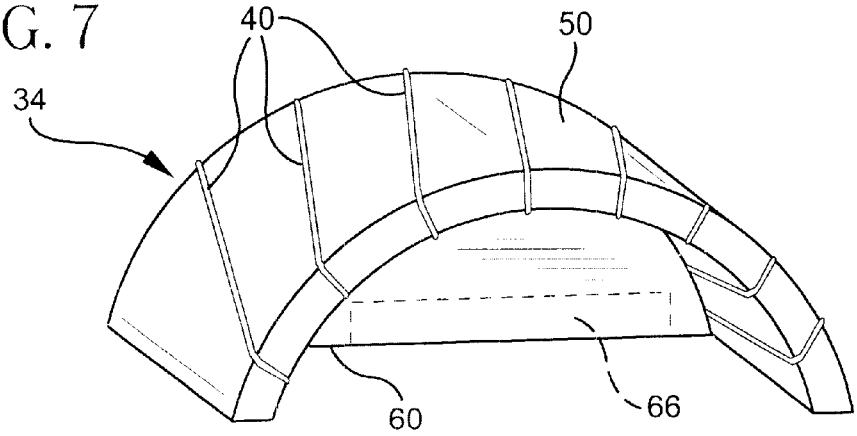
FIG. 7 is a perspective rear view of a resonator element coupled to a dielectric support substrate of the antenna assembly depicted in FIG. 1.

As shown in FIG. 6, the dielectric bridge member 60 is generally planar and includes a shaped support edge 62, a bottom edge 64 and a conductive portion 66, preferably comprising a strip of electrically conductive material. The shaped support edge 62 is preferably arcuate or substantially semicircular and serves to maintain the resonator element 40 (and resonator support substrate 50) in the configuration of the shaped support edge as seen in FIG. 7. Preferably, the shaped support edge portion 62 is roughly equivalent to the length of the resonator element 40. The conductive strip portion 66 may be used to operatively connect the dielectric bridge member 60 at a ground plane attachment point on the printed wiring board. Preferably, the conductive strip portion 66 extends substantially along the length of the bottom edge 64, but does not make electrical contact with resonator element 40.

Figure 8:
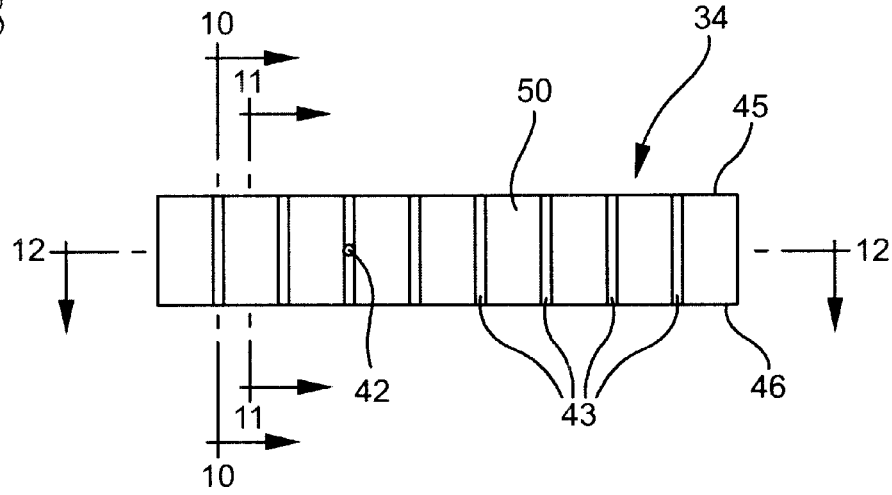
FIG. 8 is an elevational side view illustrating a portion the inwardly facing surface of a preferred embodiment of a configuration for resonator element of the antenna assembly of FIG. 1 supported by the dielectric support substrate.

A second preferred embodiment of the resonator is shown in FIGS. 8–13. FIG. 8 shows another embodiment of a resonator element 40. Flexible resonator support substrate 50 is preferably rectangular in shape and carries at least one conductive line trace 43 on an inner surface thereof. The size, composition, and number of line traces 43 and spacing between line traces 43 can be selected to precisely match the input impedance.

Figure 9:
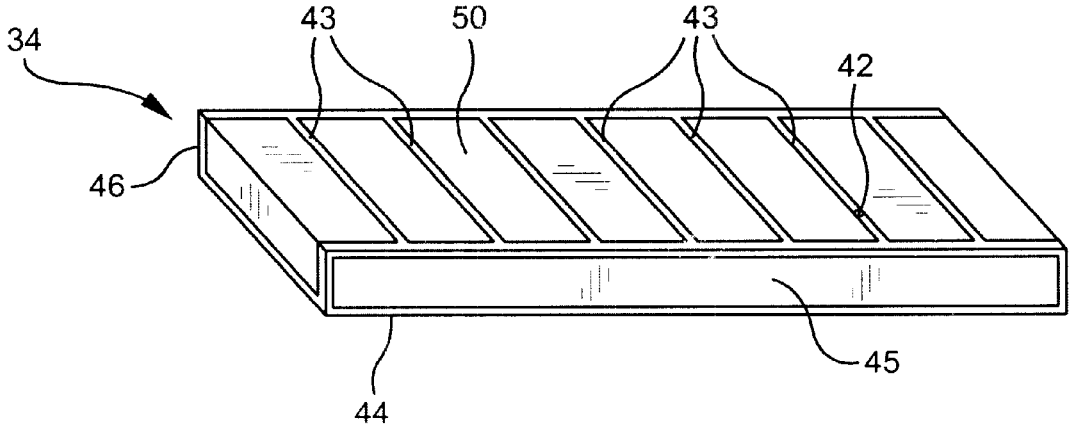
FIG. 9 is a perspective view of a portion of a preferred embodiment of the present inventive resonator assembly depicting support of the resonator element by the dielectric support substrate of the antenna assembly of FIG. 8.

FIG. 9 is a perspective view of the preferred embodiment of resonator element 40 shown in FIG. 8. In addition to the elements shown in FIG. 8, FIG. 9 shows outwardly facing conductive surface 44, and upper conductive surface 45. Flexible resonator support substrate 50 carries a conductive portion in the form of the conductive layer 44 which substantially covers the outer surface of resonator support substrate 50 and the upper and lower surfaces 45, 46 thereof, and which is in electrical contact with conductive line traces 43. Preferably, there are a plurality of conductive line traces 43 in electrical contact with conductive layer 44, with electrically conducting line traces 43 being positioned in a substantially parallel arrangement to each other, although other positions of electrically conducting line traces 43 are possible, such as diagonally or by crossing each other. Alternatively, there may be a single conductive line trace 43 meandering across the inner surfaces of the resonator support substrate 50, making at least one electrical contact with conductive layer 44.

FIGS. 8 and 9 also show a discrete electrical connection location 42 located on a conductive line 43. Discrete electrical connection location 42 may be connected to a feed line, which may be connected to the printed wiring board 22 by coaxial cable, microstrip line, or the like.

Figure 10:
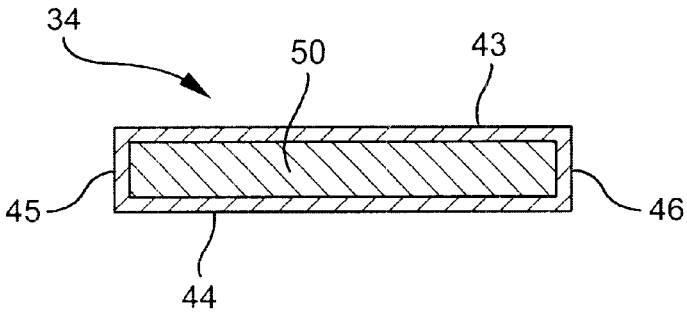
FIG. 10 is a cross sectional view of the resonator assembly of FIG. 9, taken along line 10—10 as shown in FIG. 9, and illustrating the conductive layer on the outwardly facing surface and sides, and the conductive line or trace on the inwardly facing surface.

FIG. 10 shows a cross-sectional view of the resonator element 40 of the embodiment shown in FIG. 8 taken along line 10—10. As can be seen, the conductive portion of this embodiment includes conductive layer 44, which substantially covers the outer, upper and lower side surfaces of the resonator support substrate 50, and conductive line trace 43 is configured to make electrical contact with the conductive layer 44.

Figure 11:
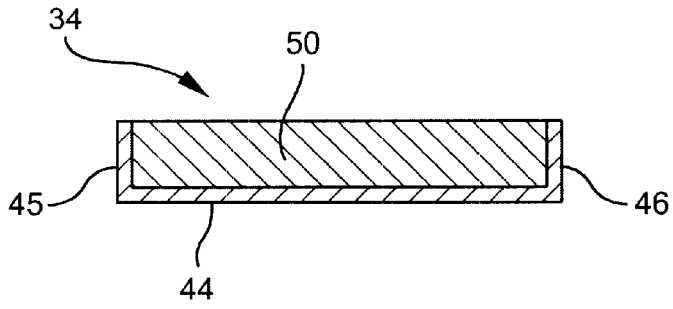
FIG. 11 is a cross sectional view of the resonator assembly of FIG. 9, taken along the line 11—11 as shown in FIG. 9, and illustrating a radial section of the resonator assembly where an electrically conducting layer is disposed on the outwardly facing surface and sides only and the non-electrically conducting dielectric support substrate only forms the inwardly facing surface of the resonator assembly.

FIG. 11 shows a cross-sectional view of the resonator element 40 shown in FIG. 8 taken along line 11—11, in between conductive line traces 43.

Figure 12:
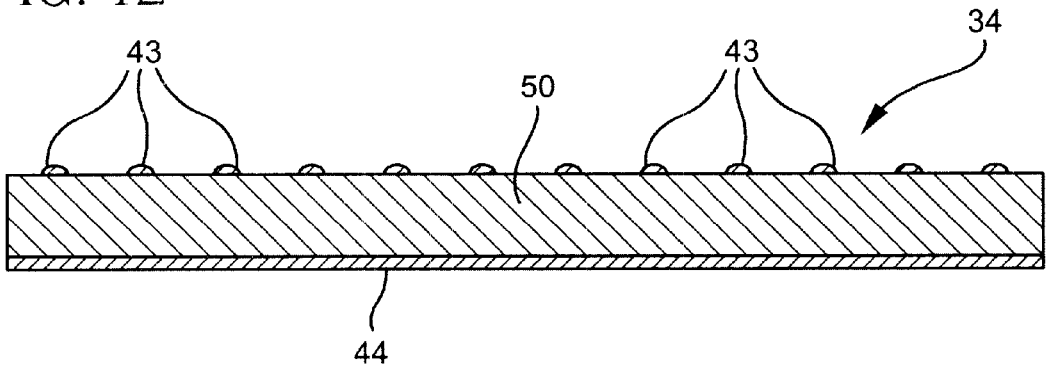
FIG. 12 is an elevational view in cross section of the resonator assembly of FIG. 9, taken along the lines 12—12 as shown in FIG. 9, and illustrating the electrically conducting materials disposed in a preferred embodiment of the present invention.

FIG. 12 is a cross-sectional view of the resonator element 40 shown in FIG. 8 along line 12—12. Although the conductive line traces 43 are shown approximately equally spaced apart, it is to be understood that the line traces 43 may be positioned in any arrangement or orientation relative to each other as long as at least one trace 43 is in electrical contact with conductive layer 44 of the resonator assembly 40.

Figure 13:
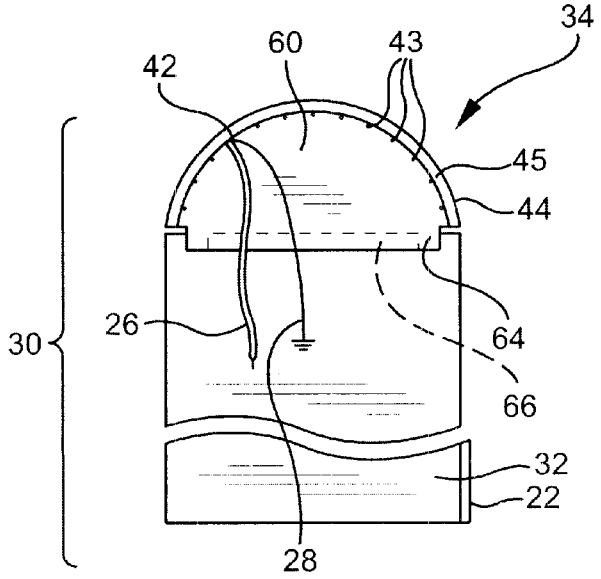
FIG. 13 is a plan view of the antenna assembly of the present invention depicting the orientation of the several major subcomponents of the antenna assembly.

FIG. 13 shows the antenna assembly 30, including the ground plane 32 and the resonator element 40. A discrete electrical connection location 42 is positioned on the conductive portion 43 of resonator element 40. A signal feed line 26 is coupled to the discrete electrical connection location 42 and may be disposed upon either surface of the dielectric bridge member 60. A ground conductor 28 is also coupled at discrete electrical connection location 42 to ground plane 32 for impedance matching requirements.

In another preferred embodiment, conductive regions or layers are defined on the resonator sub-assembly 40 by depositing regions of conductive material on the resonator support substrate 50 in a pattern. The conductive regions may be deposited by electro-plating, vapor deposition, electro-less plating or by other methods that will be apparent to those skilled in the art. Preferably the electro-less plating technique is used. The conductive layers can be formed on both sides of the flexible resonator support substrate 50, or in multiple layers, to provide a multiple band resonator.

The conductive resonator element 40 includes an outwardly facing conductive portion 44 on the outwardly facing surface of the resonator element 40 and a plurality of inwardly facing conductive portions 43 on the inwardly facing surface of the resonator element 40. Each conductive portion 43 is electrically coupled to the other of said conductive portions 43 by conductive portions 44,45,46. The plurality of inwardly facing conductive portions 43 are similarly shaped and arranged so that they are substantially transverse to the longitudinal axis of the outwardly facing conductive portion 44. Preferably, each of the plurality of inwardly facing conductive portions 43 are planar and together arranged in a spaced relation along a substantial length of the outwardly facing portion 44 of the resonator 40. The flexible resonator support substrate 50, interposed between the outwardly facing conductive portion 44 and the inwardly facing conductive portions 43 serves several functions. One function is to isolate the outwardly and inwardly facing portions 44,43 from each other. Another function is to provide a form which maintains the resonator element 40 in a desired configuration. Yet another function is to provide a platform through which the resonator element 40 may be operatively electrically connected to a WCD 10. In the preferred embodiment, the flexible resonator support substrate 50 is substantially coextensive with the longitudinal extent of the resonator element 40, and with the resonator element 40 configured into a predetermined shape, in this instance, a D-shape, although many shapes and configurations of said resonator element 40 fall squarely within the teaching of the present invention.

The resonator assembly 40 further includes a bridge support element 60, preferably formed of a dielectric material. The bridge member 60 is planar and includes opposing major planar surfaces 65,67 and a support edge 62. These surfaces 65,67 include respective conductive elements 70,72 as will be further described herein. As can be seen, a support edge 62 of bridge element 60 is configured to substantially contact the flexible resonator support substrate 50 in a non-conductive manner through a plurality of stand-off members 74. Preferably, the stand-off members 74 are co-planar with the dielectric bridge member 60 and are configured to contact the flexible resonator support substrate 50 at non-conductive areas situated adjacent the inwardly facing conductive portions 43. It is understood, however, that the particular shape and number of stand-offs 74 used may be varied. A second edge 64 of the dielectric bridge member 60 generally opposite the first edge includes extending tabs 78 to couple to printed wiring board 22.

Figure 14:
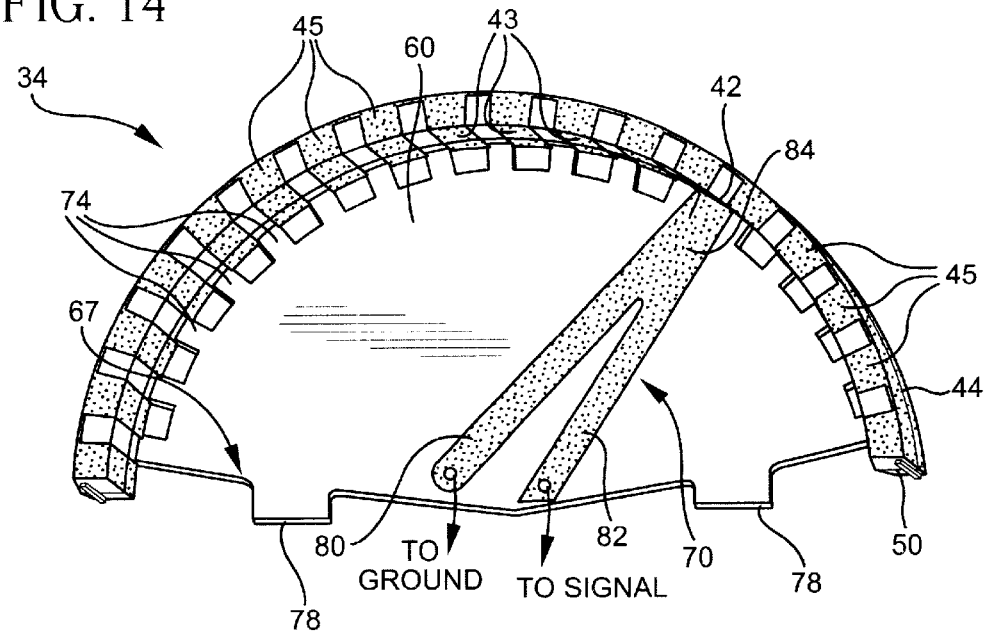
FIG. 14 is a perspective view of a part of a preferred embodiment of the antenna assembly of the present invention and showing how the resonator assembly is coupled to the dielectric bridge member and depicting the electrically conducting signal feed and ground conductor element spanning a part of the dielectric bridge member and the optional tab members (which tab members may be omitted if the conductor is disposed directly on a part of a printed wiring board).
Figure 18:
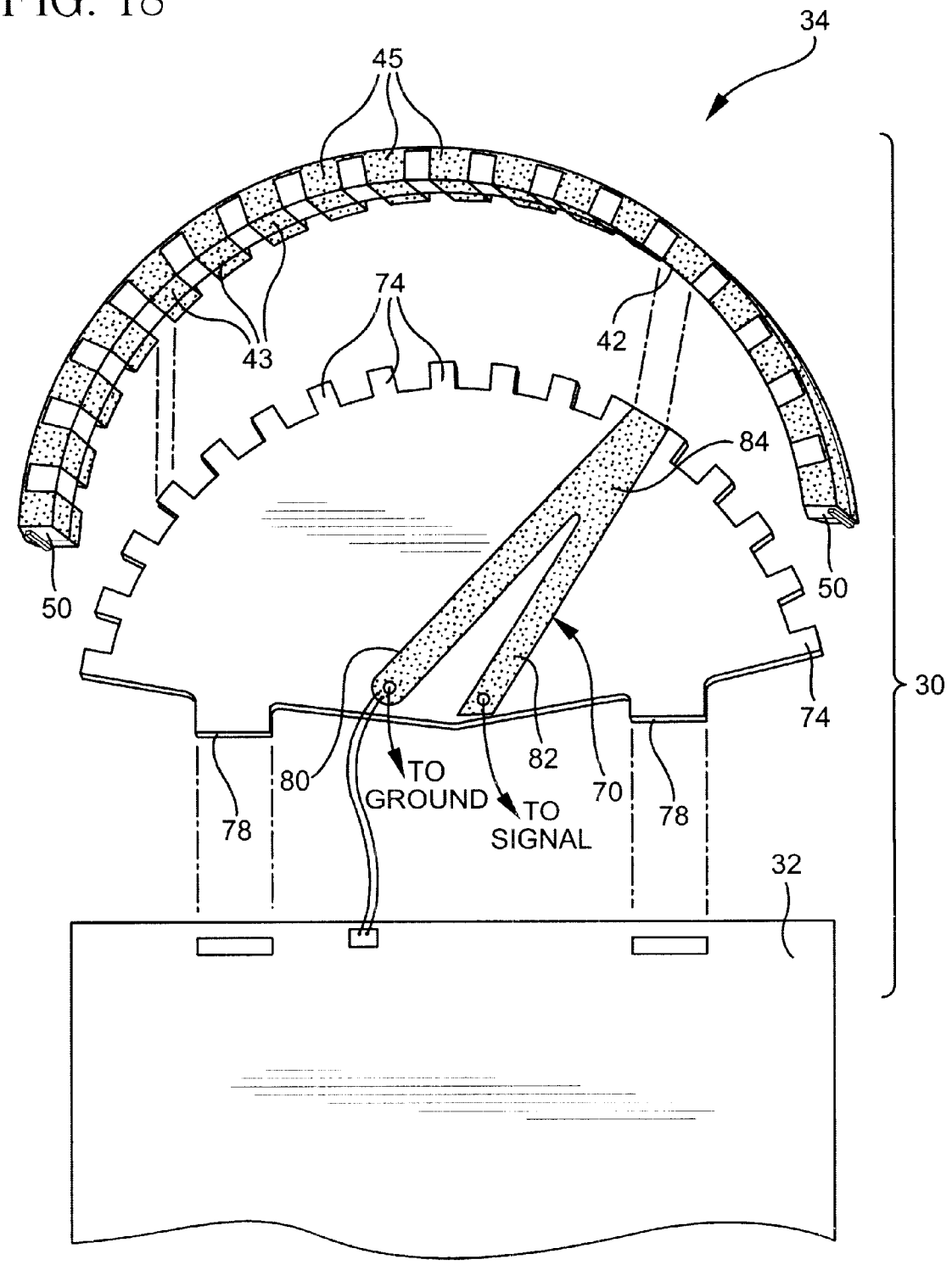
FIG. 18 is an exploded view of a part of the inventive antenna assembly depicted in FIG. 14, FIG. 15 and FIG. 16 and illustrating the orientation of the major components during assembly (although the dielectric bridge member may be integrated into the printed wiring board thereby eliminating the tab members and corresponding tab-receiving slots formed in the printed wiring board).

As illustrated in FIGS. 14, 18 and 20, surface 67 of the bridge member 60 includes a conductive element 70 having a pair of conducting arms 80,82 and a resonator element connection end 84 for coupling the WCD 10 to the resonator element 40 at signal connection 42. Conductive element 70 operatively connects the resonator element 40 to both the ground plane 32 and the RF input/output signal feed via respective conducting arms 80,82. Conductive arm 80 operatively connects the resonator element 40 to the ground plane 32 of the WCD 10 (either directly or via conductive element 72 disposed on the opposing side 65 of the bridge element 60. Conducting arm 82 operatively connects the resonator element 40 to the RF input/output signal feed of the WCD 10. The connector element 70 is arranged so that the first and second arms 80,82 extend in a generally radial direction towards the interior of the WCD 10 although this configuration is not paramount to the electrical coupling achieved thereby and alternative connector element 70 structures, geometries, and orientations may also be practicable.

Figure 15:
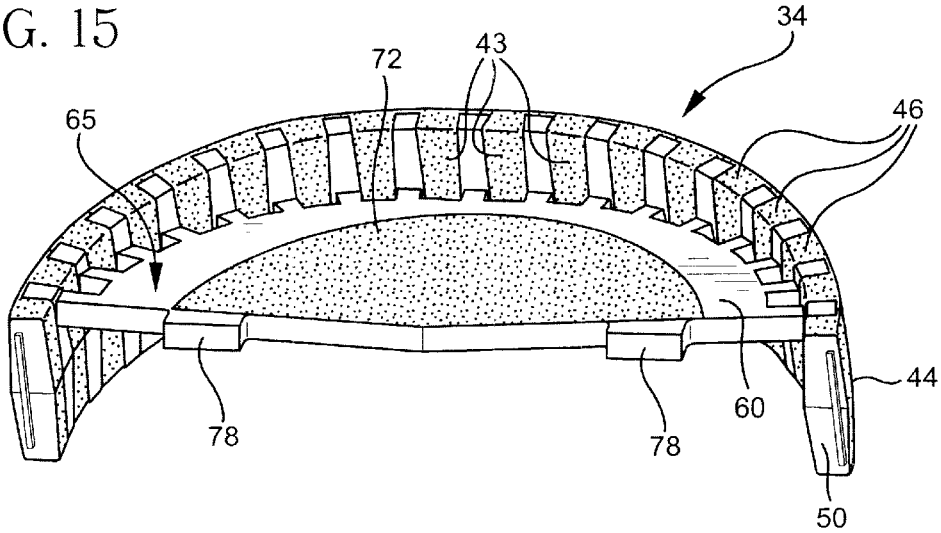
FIG. 15 is a perspective view of the opposite side of the dielectric bridge member of the antenna assembly depicted in FIG. 14 and further illustrating how the dielectric bridge member couples to the resonator assembly and the optional electrically conducting region disposed on the dielectric bridge member which when electrically coupled to a ground plane increases the effective electrical length of the ground plane of the WCD.
Figure 16:
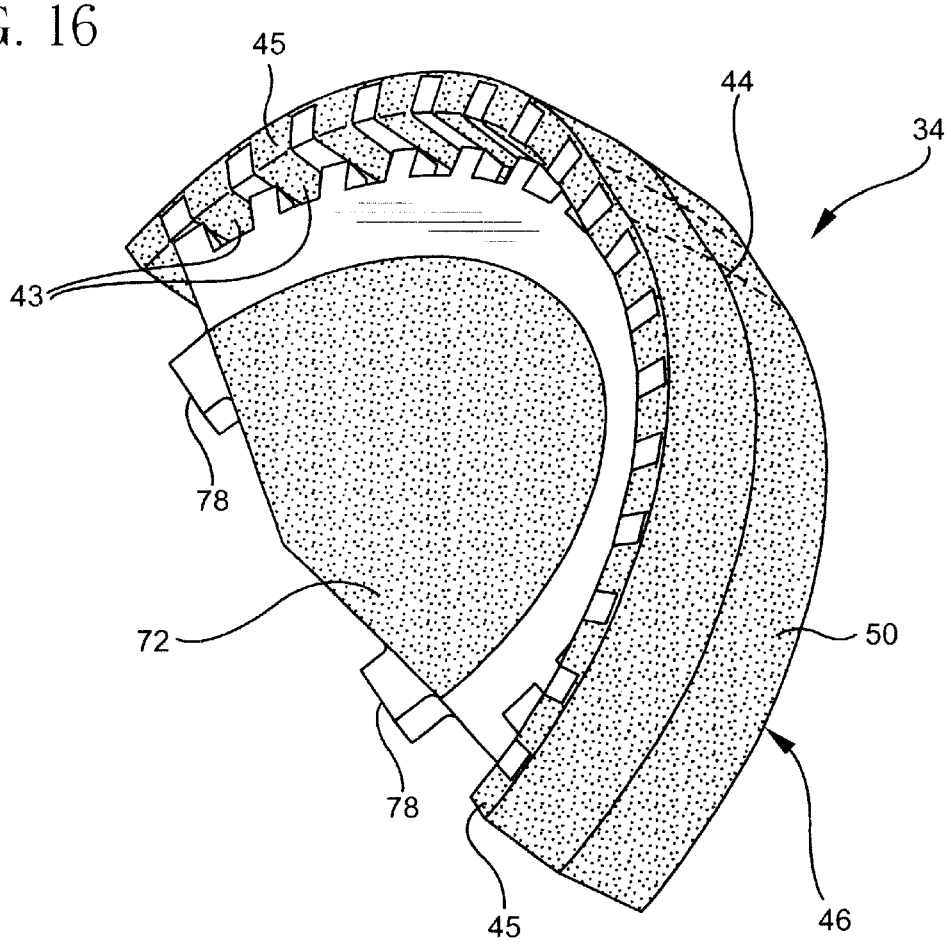
FIG. 16 is a perspective view of the antenna assembly depicted in FIG. 15 further illustrating the outwardly facing surface of the resonator assembly in relation to the dielectric bridge member.

As illustrated in FIG. 15, the bridge member 60 may include conductive element 72 on surface 65 (or implanted or disposed under surface 65 of bridge member 60) functioning both as an RF shield and as an optional extension of the ground plane 32. In a preferred embodiment, the conductive element 72 is coupled to the ground plane 32 of the WCD 10 via conductive arm 80 of conductor 70. The conductive arm 80 on opposite major surface 67 of the bridge element 60 may be coupled to the conductive element 72 through an electrically conducting via connection. The conductive element 72 is optional, and may not be needed or beneficial in particular embodiments of the present invention. The conductive element 72 may be coupled to the ground plane 32 of the WCD 10 to alter the effective electrical length of the ground plane 32 of the WCD. This may provide the antenna assembly to be configured into a more compact structure. Preferably, the optional conductive area 72 is slightly smaller than the dielectric bridge member 60 and includes a non-conductive area between the optional conductive area 72 and the inwardly facing conductive portions 43 when assembled.

Alternatively, the dielectric bridge member 60 may be omitted altogether. For example, in a situation where is no need for an optional conductive area 72, the flexible resonator support substrate 50 may be connected directly to the printed wiring board 22 and conductors may be used to connect the resonator element 40 to the ground plane 32 and an RF signal feed terminal. Or, also in a situation where there is no need for the optional conductive area 72, a dielectric bridge member 60 may be used to support the connector element 70 and to function as an attachment mechanism for the resonator element 40. In this latter instance, it is understood that the shape of the dielectric bridge member 60 need not be configured to occupy the interior space defined by the resonator element 40. That is, there may be substantial open areas. Or, the dielectric bridge member 60 may be formed into more than one part.

Note that the resonator support element 50 and the bridge element 60 do not need to be precisely perpendicular to each other. Rather, they may intersect each other at a nominal angle, with the topmost portion of the dielectric bridge member 60 adjacent the midpoint of the flexible resonator support substrate 50 and with the dielectric bridge member 60 substantially perpendicular with the flexible resonator support substrate 50. Thus, when the dielectric bridge member 60 is operatively connected to printed wiring board 22 (as shown in FIG. 1) the resonator element 40 is not tilted with respect to the ground plane 32. While the resonator element 40 and the optional conductive area 72 may intersect each other at a variety of angles, the preferred angle is around ninety degrees.

Note that the resonator element 40 may be preformed into a desired shape by several methods. One such method is to form the flexible resonator support substrate 50 into a desired shape, for example, by bending, molding, machining or otherwise manipulating the support substrate 50, and then covering selected portions of the support substrate 50 with the appropriately configured conductive portions. Alternatively, the resonator element may be formed by starting with a planar flexible resonator support substrate which is then selectively covered by appropriately configured electrically conductive portions and then manipulated into the desired shape. Thus, it should be apparent that at least during fabrication processing of the antenna assembly of the present invention, the flexible resonator support substrate 50 is preferably somewhat flexible, deformable and malleable.

Generally, the conductive portions, the connector element and the conductive area are configured into particular patterns to meet the requirements of the desired antenna frequency bands, and may be manufactured using standard printed circuit board technologies such as electroless plating, metallic deposition, etching, photo resist, or the like. Alternatively, the conductive portions, the connector element and the conductive area may be thin conductive foils or wiring which may be suitably attached, for example, by adhesives, fusion, welding, solder, or tension, to the flexible resonator support substrate 50 and the like.

The resonator assembly 34 may be mechanically attached to a printed wiring board 22 via tab members 78 located on a dielectric bridge member 60. In one preferred embodiment, the resonator assembly 40 extends from an edge of the printed wiring board 22 towards the top 18 of the housing 12 of the WCD 10. This allows an optional conductive area 72 (depicted in FIG. 15) to be electrically connected to the ground plane 32 of the antenna assembly 30 to extend the effective electrical length of said ground plane 32 as may be required for a desired operating frequency given interior dimensions of a WCD 10. Preferably, the optional conductive area 72 and the ground plane 32 are joined in a substantially co-planar relation. However, other orientations are possible, depending upon the particular operational characteristics desired. In that vein, it will also be appreciated that the total effective electrical length of the ground plane 32 and the optional conductive area 72 may be tailored to operate at a particular frequency or frequencies.

Figure 17:
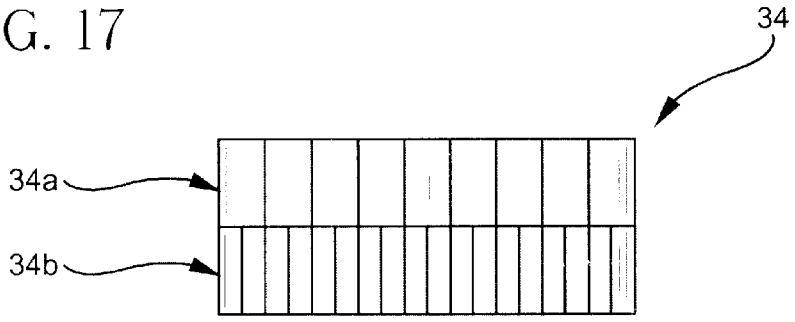
FIG. 17 is an elevational view of a portion of the resonator assembly of the present invention configured for multi-band operation using two different patterns for the resonator element and wherein the two patterns are disposed on a single resonator support substrate having a common radius.

Although each of the embodiments shown in FIGS. 1–16 includes a single curved resonating portion, as shown in FIG. 17 it is contemplated that a plurality of resonating portions 34*a* and 34*b*, stacked on top of each other, could be used for additional bands as shown in FIG. 17. Each resonating portion 34*a* and 34*b* could have a separate feed line, or, by electrically coupling each resonating portion to the other, all the resonating portions could share a single feed line. Any number of resonating sub-assemblies 34 of diverse geometry can be stacked on top of each other or disposed in remote peripheral locations within a WCD 10, as long as dimensional constraints of the WCD 10 are met.

Although the curved resonating portion 40 of the resonator assembly 34 has been shown as being generally perpendicular to the planar bridge support element 60 in these embodiments, it is understood that other orientations and shapes may be used. For example, the curved portion may be co-planar, collateral or skewed with respect to the support element. In addition, the resonating portion of the resonator assembly may be formed into different geometric shapes to fit the particular dimensions of the WCD 10.

Furthermore, the planar bridge support element 60 can be provided as an extension of the printed wiring board, with the appropriate conductive regions printed on the bridge support element 60 to provide the electrical couplings describe above.

The resonator assembly 34 can be connected to the ground plane 32 at an attachment location, as shown in the figures, although other connections are possible. For example, the bridge support element 60 may pivot relative to the ground plane, in which case the operative connection may be slip rings, wire cable or the like. Alternatively, the bridge support element 60 and the ground plane 32 may be provided with complementary connecting elements to enable to the resonator element 40 to be quickly and easily changed. This configuration could be internal to the WCD 10. In another configuration, a portion of the housing 12 of the WCD 10 could be provided with an appropriately configured slot (not shown) to enable the resonator assembly 34 to be easily attached to and removed from or replaced from the WCD 10 without having to dismantle the WCD 10.

Dielectric materials useful in the present invention may be selected with regard to their dielectric properties as required for a particular WCD application. For example, a plastic material may be selected to have a suitable loss tangent for a desired frequency of operation. The dielectric materials may be selected to have certain high temperature properties to permit solder reflow during subsequent manufacturing processes of the WCD. The dielectric elements may be injection molded using a two-shot plastic technique, with the shots providing two different plastics for defining selective adherence to a conductive plating process and the like. Preferably, the dielectric materials useful in the present invention have a dielectric constant between 1.0 and 10.0, and more preferably, around 3.0.

A material particularly preferred for the curved resonating element 40 of the resonator assembly 34 is flexible printed circuit board material comprised of a flexible dielectric material with one or more conductive material layers. The conductive layers may be manufactured using printed circuit board technologies, and may be provided in a particular pattern to meet the specifications of the desired antenna frequency bands.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. An antenna assembly for use with a wireless communication device, the antenna assembly comprising:

a resonator support substrate;

an electrically conducting element mechanically supported by the resonator support substrate;

a ground plane element of reduced electrical potential, wherein the ground plane is formed as a thin layer of electrically conducting material on a portion of a printed wiring board;

a dielectric bridge member having a first edge portion shaped to substantially support the resonator support substrate; and a signal and ground connection location of the conducting element, wherein at said connection location the conducting element is operatively coupled to both an RF signal line and the ground plane element.

2. The antenna assembly of claim 1, wherein the electrically conducting element is a metallic wire member.

3. The antenna assembly of claim 2, wherein the wire member is spirally wound about the resonator support substrate at least one turn.

4. The antenna assembly of claim 1, wherein the first edge portion of the dielectric bridge member is shaped in a curve shape.

5. The antenna assembly of claim 1, wherein the resonator support substrate is constructed of a deformable dielectric material.

6. The antenna assembly of claim 1, wherein the resonator support substrate has a longitudinal axis and includes opposing major surfaces.

7. The antenna assembly of claim 6, wherein the conductive element comprises at least one electrically conducting trace segment formed on the first major surface of the resonator support substrate.

8. The antenna assembly of claim 7, wherein the at least one electrically conducting trace line is substantially transverse to the longitudinal axis of the resonator support substrate.

9. The antenna assembly of claim 1, wherein the connection location defines a pair of operative portions of the conducting element having different operational lengths.

10. An antenna assembly in combination with a wireless communication device having a combined signal generating and receiving element and a ground plane, the antenna assembly comprising:

a resonator element;

a dielectric support element abutting the resonator element;

a conductive feed and ground element coupled at a first location to a communication signal output and coupled to a ground plane at a second location, said feed and ground element being provided upon a surface of the dielectric support element; and, wherein the resonator element and ground plane cooperatively transmit and receive electromagnetic communication signals.

11. The antenna assembly of claim 10, wherein the resonator element is disposed upon a shaped support edge portion which is curved.

12. The antenna assembly of claim 10, wherein the conductive portion is a wire member.

13. The antenna assembly of claim 12, wherein the wire member is spirally wound about the resonator element at least one turn.

14. The antenna assembly of claim 10, wherein the resonator element has a longitudinal axis and includes opposing major surfaces, and wherein the conductive portion comprises at least one electrically conducting trace on one of the opposing major surfaces of the resonator element.

15. The antenna assembly of claim 14, the conductive portion further comprising an electrically conductive layer on a substantial portion of the other major surface of the resonator element.

16. The antenna assembly of claim 14, wherein the conductive portion is a conductive layer deposited on a major surface of the resonator element.

17. The antenna assembly of claim 16, wherein the conductive layer forms an array pattern on the major surface.

18. The antenna assembly of claim 16, wherein the array pattern includes a plurality of equally spaced, parallel elements.

19. The antenna assembly of claim 18, wherein the support element comprises at least one tooth structure.

20. The antenna assembly of claim 16, wherein the support element comprises a conductive layer on a major surface of the support element.

21. The antenna assembly of claim 20, wherein the conductive layer operates to electrically couple the antenna assembly with the wireless communication device.

22. An antenna assembly for use with a wireless communication device, the antenna assembly comprising:

a resonator element composed of an electrically conducting material, said resonator element defining a signal and ground connection location;

a flexible resonator support substrate supporting the resonator element;

a dielectric bridge member supporting the resonator support substrate in a generally orthogonal relationship relative to a plane containing the resonator support substrate;

a ground plane;

wherein the flexible resonator support substrate and the dielectric bridge member are mechanically connected together; and wherein the resonator element is operatively coupled to both the ground plane and to an RF signal line at the connection location.

23. The antenna assembly of claim 22, wherein a portion of the flexible resonator support substrate is curved and wherein the dielectric bridge member has a curved support edge which mechanically connects the flexible resonator support substrate to the dielectric bridge member.

24. The antenna assembly of claim 23, wherein the curved support edge of the dielectric bridge member includes at least one non-conductive stand-off member.

25. The antenna assembly of claim 23, wherein the dielectric bridge member includes an edge having at least one tab extending therefrom, for mechanically coupling the antenna assembly to the ground plane of a wireless communication device.

26. The antenna assembly of claim 22, wherein the resonator element has an elongate band on a first surface and a transverse band portion defined on a second surface generally opposite the first surface and wherein the connection location is defined upon the transverse band portion.

27. The antenna assembly of claim 26, further comprising:

an additional transverse band portion having different conductive regions as compared to the other transverse band portion.

28. The antenna assembly of claim 26, wherein an outwardly facing portion of the elongate band is substantially curved.

29. A resonator element for use in an antenna assembly having an RF signal line and a ground plane, the resonator element comprising:

an elongate band of conductive material; and, a transverse band of conductive material operatively connected to the elongate band in a spaced relation, said transverse band having a plurality of spaced conductive elements, at least one of the plurality of conductive elements defining a signal and ground connection location wherein the RF signal line and the ground plane are operatively coupled to the transverse band at the connection location, wherein the elongate band of conductive material is curved and wherein the location of transverse band relative to the elongate band is predetermined.

30. The resonator element of claim 29, further comprising at least one or more additional transverse bands of conductive material.

31. The resonator element of claim 30, further comprising a flexible resonator support substrate, the flexible resonator support substrate in supporting relation to the elongate band and the transverse band.

32. An antenna assembly for use in wireless communications device having an RF signal line and a ground plane, the antenna assembly comprising:

a resonator element being operatively coupled to the RF signal line and the ground plane proximate a connection location;

a flexible resonator support substrate, the flexible resonator support substrate in supporting relation to the resonator element;

a feed and ground conductor supported upon the resonator support substrate and connected at one end to the resonator element at the connection location and connected to the RF signal line and the ground plane at an opposite end; and a dielectric bridge member, the dielectric bridge member in supporting relation to the resonator element, wherein the flexible resonator support substrate and the dielectric bridge member are mechanically connected to each other.

33. The antenna assembly of claim 32, wherein the flexible resonator support substrate is curved and wherein the dielectric bridge member has a predetermined support edge which operatively connects the flexible resonator support substrate to the dielectric bridge member in the non-conducting relation.

34. The antenna assembly of claim 33, wherein the predetermined support edge of the dielectric bridge member includes at least one stand-off.

35. The antenna assembly of claim 33, wherein the dielectric bridge member includes a downwardly facing edge having at least one tab extending therefrom for mechanically connecting the antenna assembly to the ground plane of a wireless communication device.

36. An antenna assembly for a wireless communication device, comprising:

a resonator means for receiving and transmitting radio frequency communication signals;

communication circuitry means for transforming radio frequency communication signals received by the resonator means into audible communication signals and for transforming audible communication to radio frequency communication signals transmitted by the resonator means; and, wherein the resonator means is electrically coupled to a ground plane of reduced electrical potential; and wherein the resonator means further comprises:

a resonator support substrate having a curved shape; and, an electrically conducting element mechanically supported by the resonator support substrate and also having a curved shape, wherein the electrically conducting element is fed at a connection location, and wherein a ground and feed conductor element is connected to the electrically conducting element at the connection location at a first end thereof, and the ground and feed conductor element is connected to the communication circuitry means and a ground plane at an opposite end thereof.

* * * * *